US009067330B2

(12) United States Patent
Kawaguchi et al.

(10) Patent No.: US 9,067,330 B2
(45) Date of Patent: Jun. 30, 2015

(54) CUTTING APPARATUS

(71) Applicant: BROTHER KOGYO KABUSHIKI KAISHA, Nagoya-Shi (JP)

(72) Inventors: Yasuhiko Kawaguchi, Nagoya (JP); Tomoyasu Niizeki, Ichinomiya (JP); Yoshinori Nakamura, Toyohashi (JP); Masahiko Nagai, Nagoya (JP)

(73) Assignee: BROTHER KOGYO KABUSHIKI KAISHA, Nagoya-shi (JP)

( * ) Notice: Subject to any disclaimer, the term of this patent is extended or adjusted under 35 U.S.C. 154(b) by 220 days.

(21) Appl. No.: 13/626,200

(22) Filed: Sep. 25, 2012

(65) Prior Publication Data

US 2013/0104713 A1 May 2, 2013

(30) Foreign Application Priority Data

Oct. 26, 2011 (JP) ..... 2011-235014

(51) Int. Cl.

| | |
|---|---|
| ***B26F 1/36*** | (2006.01) |
| ***B26D 5/02*** | (2006.01) |
| ***B26D 7/26*** | (2006.01) |
| ***B26F 1/38*** | (2006.01) |

(52) U.S. Cl.

CPC ..... *B26D 7/2628* (2013.01); *B26F 1/3813* (2013.01); *B26D 2007/2678* (2013.01)

(58) Field of Classification Search

USPC ..... 83/76.1, 368, 881, 76.8, 371, 56, 71, 83/522, 875, 880, 879, 72, 74; 400/621

See application file for complete search history.

(56) References Cited

U.S. PATENT DOCUMENTS

| | | | | | |
|---|---|---|---|---|---|
| 3,236,111 | A | * | 2/1966 | Naslund | 74/50 |
| 3,805,650 | A | * | 4/1974 | Pearl | 83/56 |
| 4,094,217 | A | * | 6/1978 | Exline | 83/879 |
| 4,178,820 | A | * | 12/1979 | Gerber | 83/13 |
| 6,131,498 | A | * | 10/2000 | Gerber | 83/647 |
| 2005/0186010 | A1 | | 8/2005 | Shibata et al. | |

FOREIGN PATENT DOCUMENTS

JP 2005-205541 A 8/2005

* cited by examiner

*Primary Examiner* — Ghassem Alie

(74) *Attorney, Agent, or Firm* — Fox Rothschild LLP

(57) ABSTRACT

A cutting apparatus includes an angle change unit configured to change an angle made by a cutting blade and an object to be cut. The angle change unit is configured to change the angle between a first angle during a non-cutting time and a second angle at which the blade is tilted during a cutting time so that the second angle is rendered smaller than the first angle. The first abutment limits a swinging movement of the blade while the first angle is made by the blade and the object. The second abutment limits the swinging movement of the blade while the second angle is made by the blade and the object. The angle between the blade and the object is changed from the first angle to the second angle by resistance to which the blade is subjected from the object with the relative movement of the blade.

1 Claim, 11 Drawing Sheets

CUTTING APPARATUS

CROSS-REFERENCE TO RELATED APPLICATIONS

This application is based upon and claims the benefit of priority from the prior Japanese Patent Application No. 2011-235014 filed on Oct. 26, 2011, the entire contents of which are incorporated herein by reference.

BACKGROUND

1. Technical Field

The present disclosure relates to a cutting apparatus in which a cutting blade and an object to be cut are moved relative to each other so that the object is out into a desired shape.

2. Related Art

There has conventionally been known a cutting plotter which automatically cuts a sheet such as paper, for example. The sheet is affixed to a base material serving as a holding member having an adhesive layer on a surface thereof. The cutting plotter includes a drive mechanism having a pair of rollers which are vertically disposed and hold both ends of the base material therebetween so that the object is moved in a first direction. The cutting apparatus also includes a cutter holder which supports a cutting blade and is moved in a second direction perpendicular to the first direction, whereby the sheet is cut.

FIG. 11 schematically illustrates a commonly-used cutter (a cutting blade) 100 and a cutter holder 101 both employed in conventional cutting plotters. As shown, the cutter 100 is fixed to a lower end of a bar-like cutter shaft 102 by a screw 103. The cutter shaft 102 is mounted on a bearing 101 so as to be rotatable about an axis O. The bearing 104 is provided in a recess 101*a* formed in a lower end of the cutter holder 101. The cutter 100 includes a blade portion 100*a* which is located so that a lowermost end blade edge 100*b* thereof is offset by distance d relative to the axis O. Accordingly, when the sheet 105 is cut by the cutter 100 with the movement of the cutter 100 and the sheet 105 relative to each other, the blade edge 100*b* of the cutter 100 is subjected to resistance (reactive force) such that the cutter shaft 102 is rotated about the axis O. More specifically, the direction of the blade edge 100*b* of the cutter 100 is automatically changed according to a direction in which the cutter 100 and the sheet 105 are moved relative to each other.

The resistance to which the blade edge 100*b* of the cutter 100 is subjected is rendered large when cutting is executed by the cutting plotter. In order that the load applied to the cutter 100 may be rendered smaller for improvement in the sharpness of the cutter 100, an angle $\alpha$ between the blade 100*a* of the cutter 100 and the sheet 105 has been suggested to be set to a small value.

On the other hand, when a cutting line of the sheet 105 includes a corner, which is cut by the cutter 100, the cutter 100 is rotatively moved so as to slightly pry or twist a distal end of the corner, whereby the direction of the blade edge 100*b* is changed. Accordingly, the angle $\alpha$ is desirable to be set to a large value. Thus, the cutter 100 has conflicting advantages and disadvantages when the angle $\alpha$ is set to both a small value and a large value, respectively. It is desirable to simultaneously overcome the disadvantages in the two cases.

SUMMARY

Therefore, an object of the disclosure is to provide a cutting apparatus which can improve the sharpness of the cutter during the cutting operation and which can suitably move the cutting blade and the object relative to each other.

The present disclosure provides a cutting apparatus in which a cutting blade and an object to be cut are moved relative to each other based on cutting data set therein so that the object is cut into a desired shape by the cutting blade. The apparatus includes an angle change unit which is configured to change an angle made by the cutting blade and the object. The angle change unit is configured to change the angle between a first angle during a non-cutting time and a second angle at which the cutting unit is tilted during a cutting time so that the second angle is rendered smaller than the first angle. The angle change unit includes a support shaft which supports the cutting blade between the first and second angles so that the cutting blade is swingable, a mounting member which fixes the support shaft and a pair of first and second abutments which are mounted on the mounting member so as to be capable of abutting against the cutting blade. The first abutment limits the swinging movement of the cutting blade when abutting against the cutting blade while the first angle is made by the cutting blade and the object. The second abutment limits the swinging movement of the cutting blade when abutting against the cutting blade while the second angle is made by the cutting blade and the object. The angle change unit also includes an elastic member which is provided between the mounting member and the cutting blade to elastically bias the cutting blade in a direction such that the cutting blade abuts against the first abutment during the non-abutting period. The angle between the cutting blade and the object is changed from the first angle to the second angle by a resistance to which the cutting blade is subjected from the object during the cutting time with the relative movement of the cutting blade during the cutting time.

DETAILED DESCRIPTION

Figure 1:
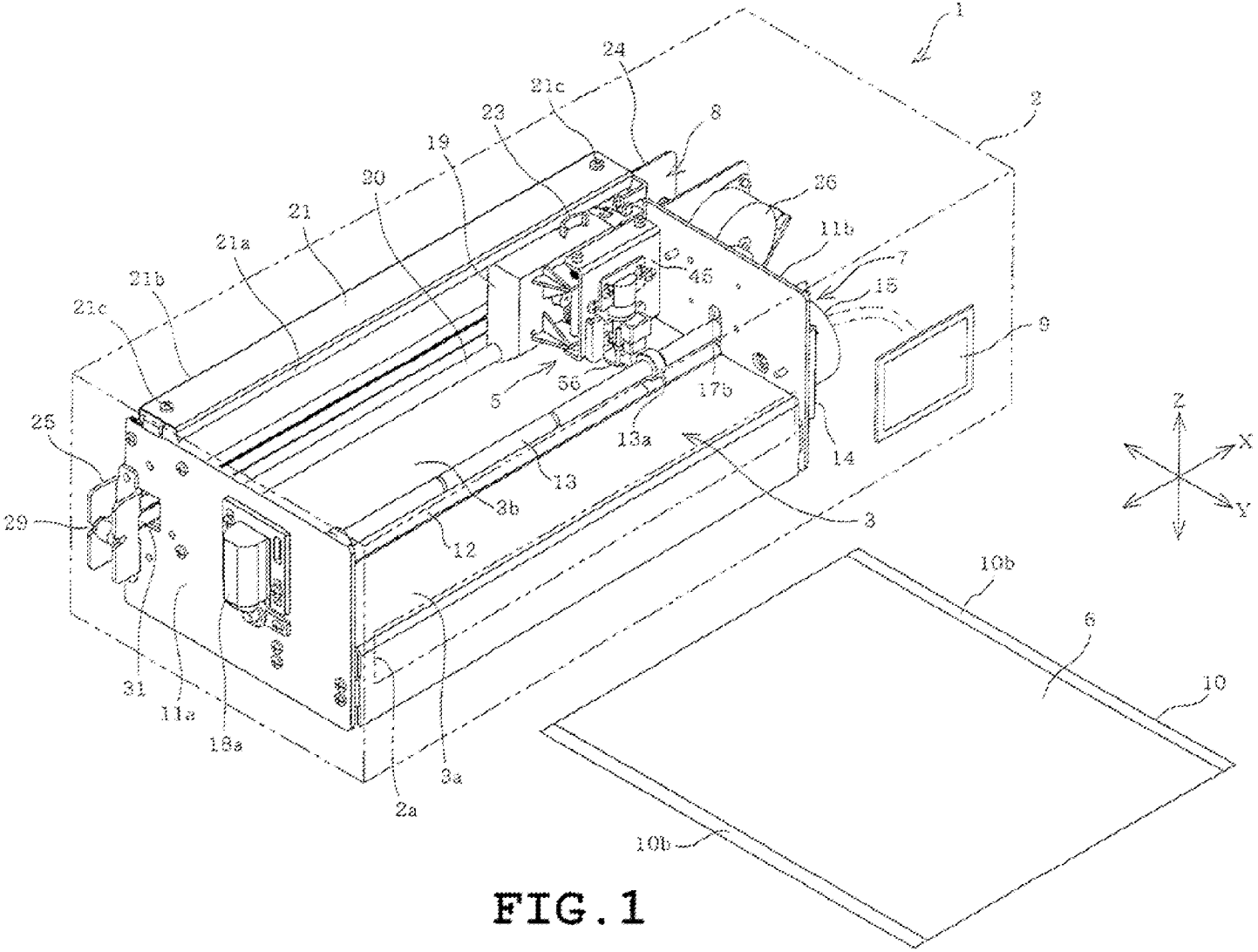
FIG. 1 is a perspective view of the cutting apparatus according to one embodiment, showing an inner structure thereof.

One embodiment will be described with reference to FIGS. 1 to 10. Referring to FIG. 1, a cutting apparatus 1 includes a body cover 2 as a housing, a platen 3 provided in the body cover 2 and a cutter holder 5 also provided in the body cover 2. The cutting apparatus 1 also includes first and second moving units 7 and 8 for moving a cutter 4 (see FIG. 4) of the cutter holder 5 and an object 6 to be cut, relative to each other. The body cover 2 is formed into the shape of a horizontally long rectangular box and has a front formed with a horizontally long opening 2*a* which is provided for setting a holding sheet 10 holding the object 6. In the following description, a direction in which the object 6 is moved by the first moving unit 7 will be referred to as "front-back direction" and more specifically, the side of the cutting apparatus 1 where the opening 2*a* is located will be referred to as "front" and the opposite side will be referred to as "back." The front-back direction will be referred to as "Y direction." The right-left direction perpendicular to the Y direction will be referred to as "X direction."

Figure 7:
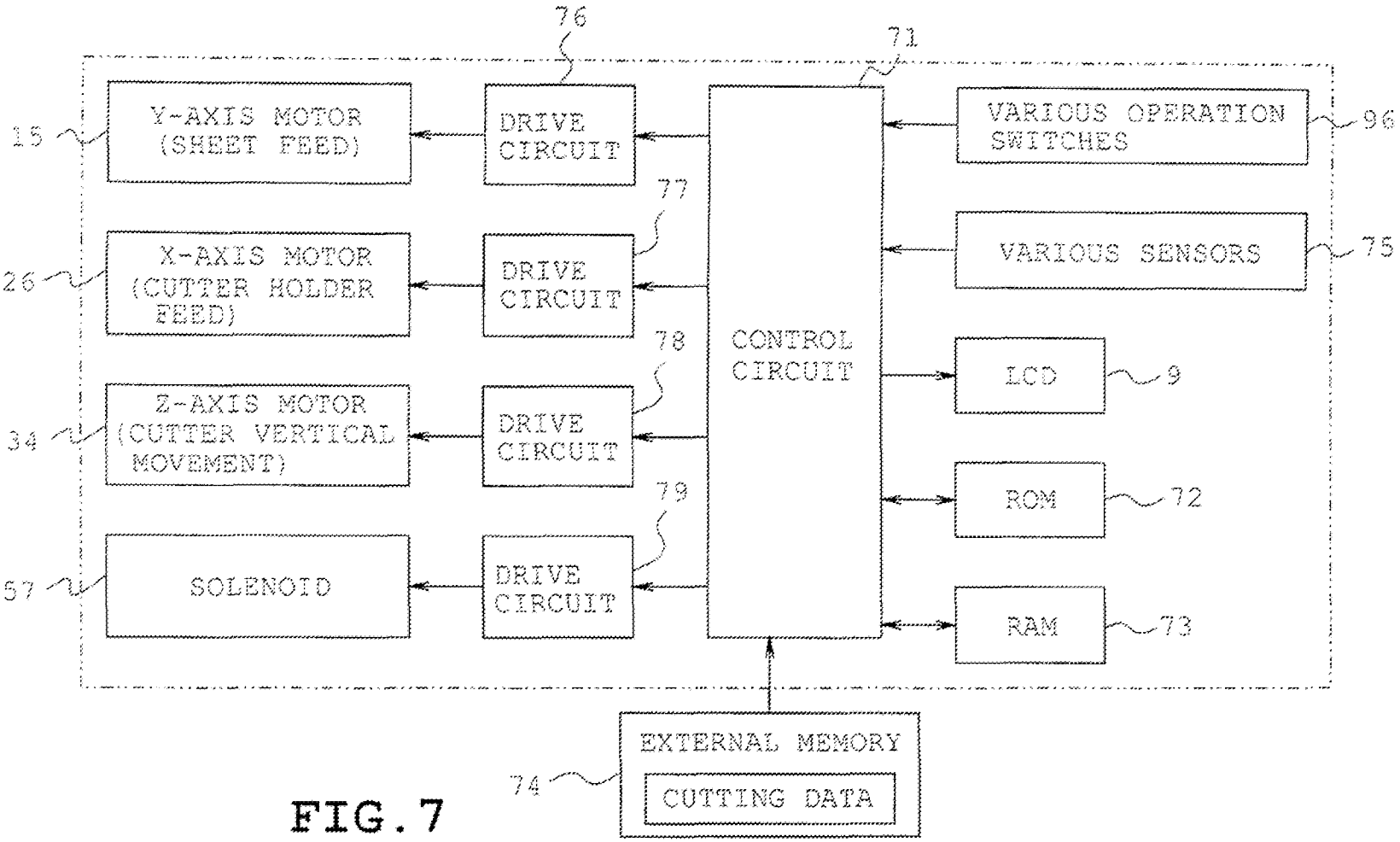
FIG. 7 is a block diagram showing an electrical arrangement of the cutting apparatus.

On a right part of the body cover 2 are provided a liquid crystal display (LCD) 9*a* and a plurality of operation switches 9*b* (see FIG. 7). The LCD 9*a* serves as a display unit displaying messages and the like necessary for the user. The operation switches 9*b* serve as input units for the user to supply various instructions, selections and inputs to the cutting apparatus 1.

The platen 3 includes a pair of front and rear plate members 3*a* and 3*b* and has an upper surface which is configured into an X-Y plane serving as a horizontal plane. The platen 3 is set so that the holding sheet 10 holding the object 6 is placed thereon. The holding sheet 10 is received by the platen 3 when the object 6 is cut. The holding sheet 10 has an upper surface with an adhesive layer 10*a* (see FIG. 9A) formed by applying an adhesive agent to a part thereof except for right and left edges 10*b*. The object 6 is affixed to the adhesive layer 10*a* thereby to be held.

Figure 2:
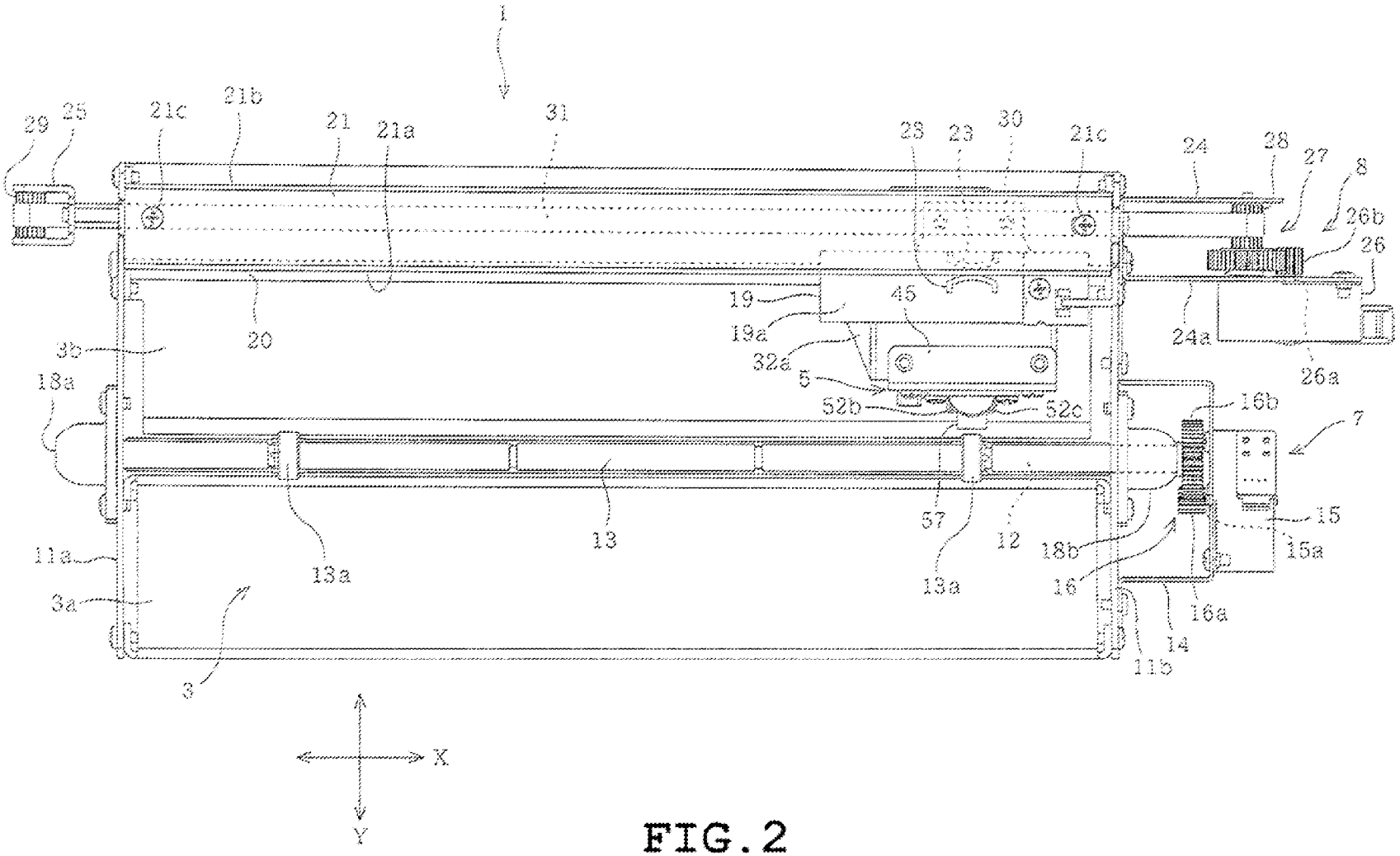
FIG. 2 is a plan view of the cutting apparatus.

The first moving unit 7 moves the holding sheet 10 on the upper surface side of the platen 3 in the Y direction (a first direction). More specifically, a driving roller 12 and a pinch roller 13 are provided on right and left sidewalls 11*b* and 11*a* so as to be located between plate members 3*a* and 3*b* of the platen 3. The driving roller 12 and the pinch roller 13 extend ill the X direction and are rotatably supported on the sidewalls 11*b* and 11*a*. The driving roller 12 and the pinch roller 13 are disposed so as to be parallel to the X-Y plane and so as to be vertically arranged. The driving roller 12 is located above the pinch roller 13. A first crank-shaped mounting frame 14 is mounted on the right sidewall 11*b* so as to be located on the right of the driving roller 12 as shown in FIG. 2. A Y-axis motor 15 is fixed to an outer surface of the mounting frame 14.

The Y-axis motor 15 comprises a stepping motor, for example and has a rotating shaft 15*a* extending through a hole not shown) of the first mounting frame 14 and further has a distal end provided with a gear 16*a*. The driving roller 12 has a right end to which is secured another gear 16*b* which is brought into mesh engagement with the gear 16*a*. These gears 16*a* and 16*b* constitute a first reduction gear mechanism 16. The pinch roller 13 is guided by guide grooves 17*b* formed in the right and left sidewalls 11*b* and 11*a* so as to be movable upward and downward. Only the right guide groove 17*b* is shown in FIG. 1. Two spring accommodating members 18*a* and 18*b* are mounted on the right and left sidewalls 11*b* and 11*a* in order to cover the guide groove 17*b* from the outside respectively. The pinch roller 13 is biased downward by compression coil springs (not shown) accommodated in the spring accommodating portions 18*a* and 18*b* respectively. The pinch roller 13 is provided watt pressing portions 13*a* which are brought into contact with both right and left edges 10*b* of the holding sheet 10, thereby pressing the edges 10*b*, respectively. Each pressing portion 13*a* has a slightly larger outer diameter than the other portion of the pinch roller 13.

The driving roller 12 and the pinch roller 13 press the holding sheet 10 from below and from above by the biasing force of the compression coil springs thereby to hold the holding sheet 10 therebetween (see FIG. 5). Upon drive of the Y-axis motor 15, normal or reverse rotation of the Y-axis motor 15 is transmitted via the first reduction gear mechanism 16 to the driving roller 12, whereby the holding sheet 10 is moved backward or forward together with the object 6. The first moving unit is thus constituted by the driving roller 12, the pinch roller 13, the Y-axis motor 15, the first reduction gear mechanism 16, the compression coil springs and the like.

The second moving unit 8 moves a carriage 19 supporting the cutter holder 5 in the X direction (a second direction). The second moving unit 8 will be described in more detail. A guide shaft 20 and a guide frame 21 both extending in the right-left direction are provided between the right and left sidewalls 11*b* and 11*a* so as to be located at the rear end of the cutting apparatus 1, as shown in FIGS. 1 and 2. The guide shaft 20 is disposed in parallel with the driving roller 12 and the pinch roller 13. The guide shaft 20 located right above the platen 3 extends through a hole of a lower part of the carriage 19 (a through hole 22 as will be described later). The guide frame 21 has a front edge 21*a* and a rear edge 21*b* both folded downward such that the guide frame 21 has a generally C-shaped section. The front edge 21*a* is disposed in parallel with the guide shaft 20. The guide frame 21 is adapted to guide an upper part (guided members 23 as will be described later) of the carriage 19 by the front edge 21*a*. The guide frame 21 is fixed to upper ends of the sidewalls 11*a* and 11*b* by screws 21*c* respectively.

A second mounting frame 24 is mounted on the right sidewall 11*b* in the rear of the cutting apparatus 1, and an auxiliary frame 25 is mounted on the left sidewall 11*a* in the rear of the cutting apparatus 1, as shown in FIG. 2. An X-axis motor 26 and a second reduction gear mechanism 27 are mounted on the second mounting frame 24. The X-axis motor 26 comprises a stepping motor, for example and is fixed to a front of a front mounting piece 24*a*. The X-axis motor 26 includes a rotating shaft 26*a* which extends through a hole (not shown) of the mounting piece 24*a* and has a distal end provided with a gear 26*b* which is brought into mesh engagement with the second reduction gear mechanism 27. A pulley 28 is rotatably mounted on the second reduction gear mechanism 27, and another pulley 29 is rotatably mounted on the left auxiliary frame 25 as viewed in FIG. 2. An endless timing belt 31 connected to a rear end (a mourning portion 30 as will be described later) of the carriage 19 extends between the pulleys 28 and 29.

Upon drive of the X-axis motor 26, normal or reverse rotation of the X-axis motor 26 is transmitted is the second reduction gear mechanism 27 and the pulley 28 to the timing belt 31, whereby the carriage 19 is moved leftward or rightward together with the cutter holder 5. Thus, the carriage 19 and the cutter holder 5 are moved in the X direction perpendicular to the Y direction in which the object 6 is conveyed. The second moving unit 8 is constituted by the above-described guide shaft 20, the guide frame 21, the X-axis motor 26, the second reduction gear mechanism 27, the pulleys 28 and 29, the timing belt 31, the carriage 19 and the like.

Figure 3:
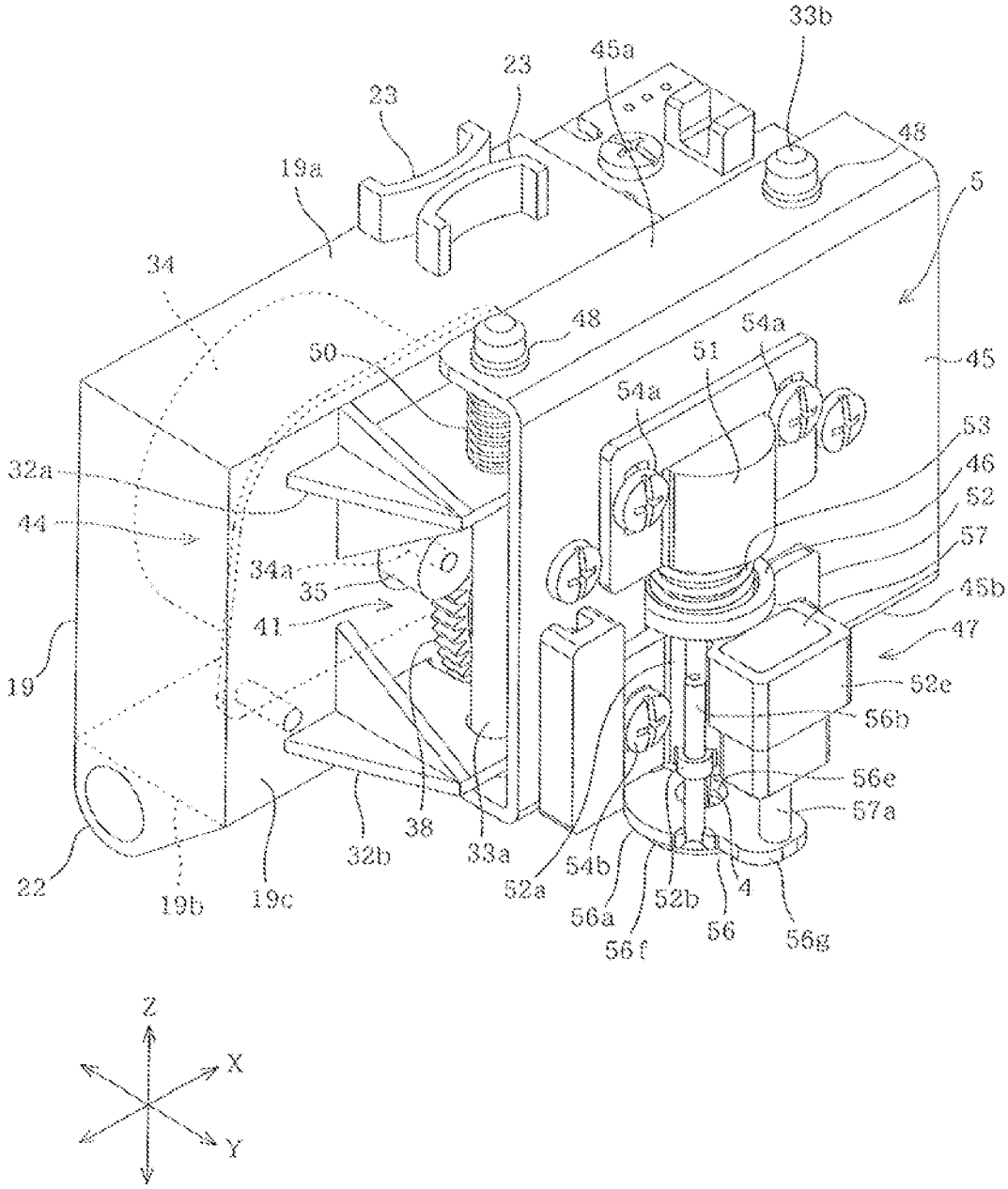
FIG. 3 is a perspective view of a cutter holder.
Figure 4:
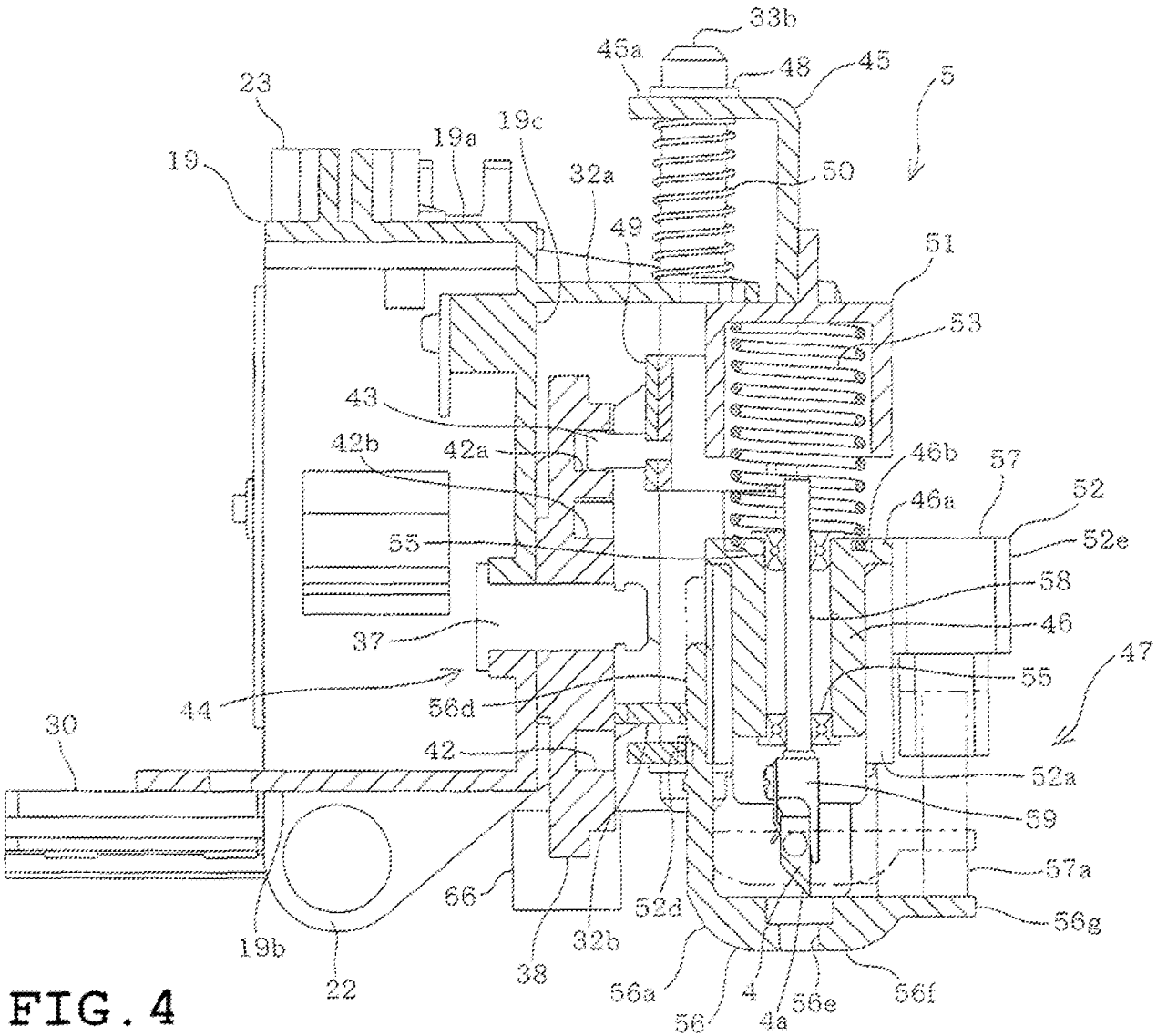
FIG. 4 is a sectional view of the cutter holder, showing the case where the cutter has been ascended.

The cutter holder 5 is disposed on the front of the carriage 19 and is supported so as to be movable in a vertical direction (a third direction) serving as a Z direction. The carriage 19 and the cutter holder 5 will be described with reference to FIGS. 3 to 6 as well as FIGS. 1 and 2. The carriage 19 is formed into the shape of a substantially rectangular box with an open rear as shown in FIGS. 2 and 3. The carriage 19 has an upper wall 19*a* with which a pair of upwardly protruding front and rear guided members 23 are integrally formed. The guided members 23 are arc-shaped ribs as viewed in a planar view. The guided members 23 are symmetrically disposed with a front edge 21*a* of the guide frame 21 being interposed therebetween. The carriage 19 has a bottom wall 19*b* further having a downwardly expanding portion which is formed with a pair of right and left through holes 22 through which the guide shaft 20 is inserted, as shown in FIG. 4. An attaching portion 30 (see FIGS. 4 and 5) is mounted on the bottom wall 19*b* of the carriage 19 so as to protrude rearward. The attaching portion 30 is to be coupled with the timing belt 31. The carriage 19 is thus supported by the guide shaft 20 inserted through the holes 22 so as to be slideable in the right-left direction and further supported by the guide frame 21 held between the guided members 23 so as to be prevented from being rotated about the guide shaft 20.

Figure 5:
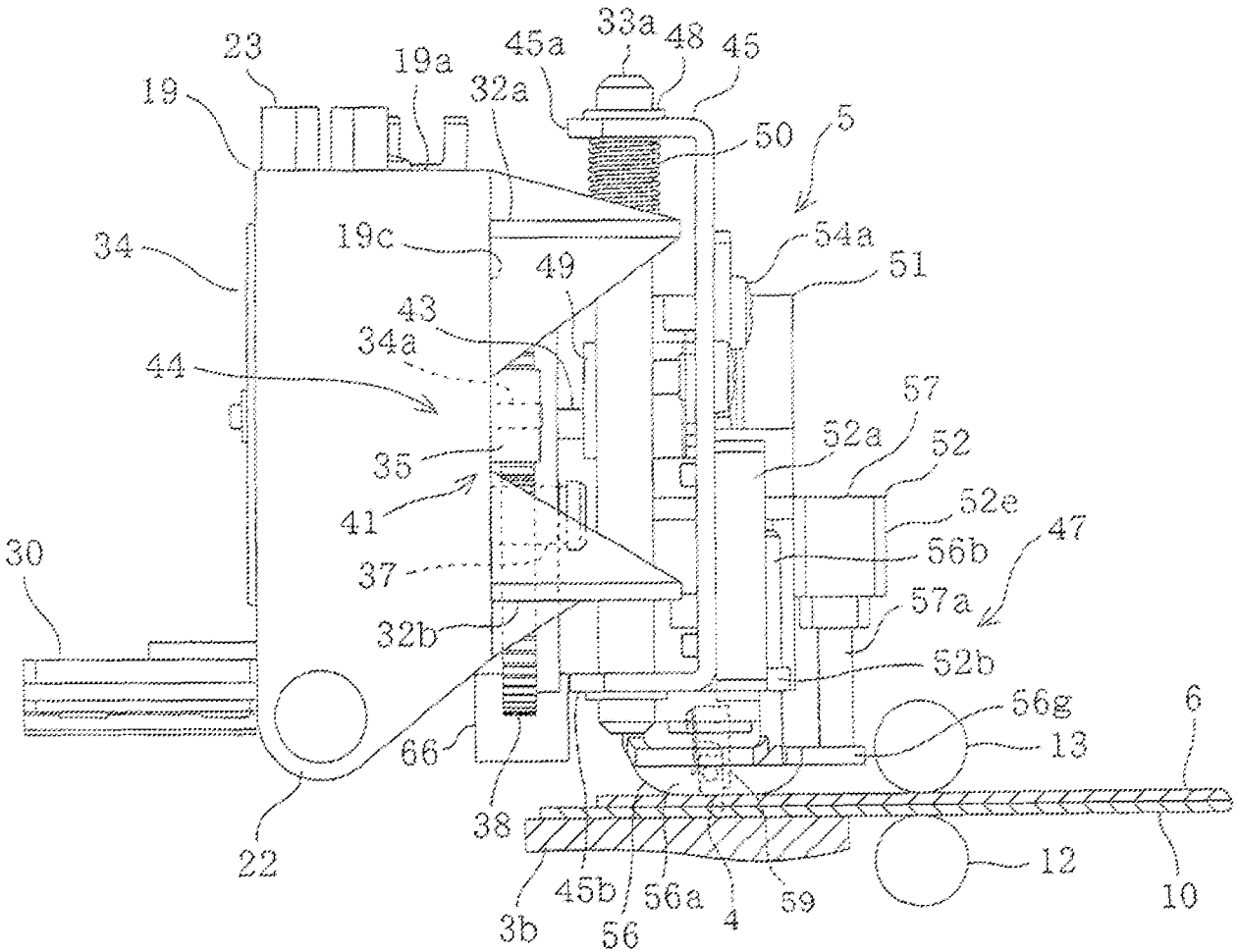
FIG. 5 is a side view of the cutter holder and its vicinity, showing the case where the cuter has been descended.
Figure 6:
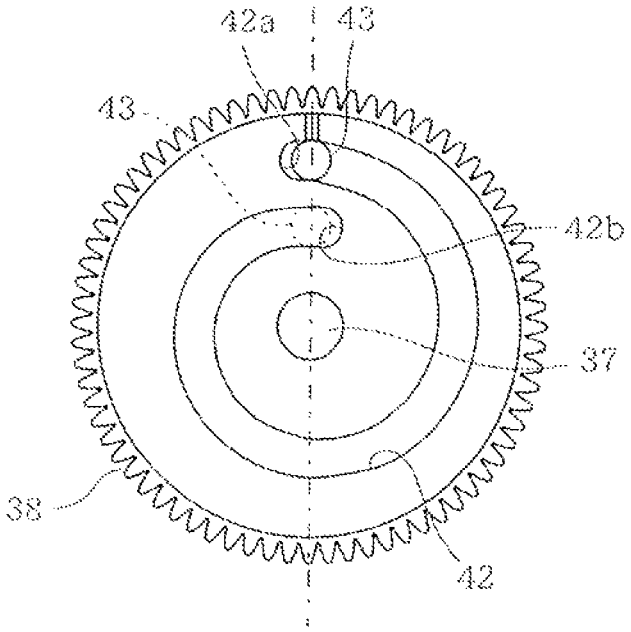
FIG. 6 is an enlarged front view of a gear.

The carriage 19 has a front wall 19*c* with which a pair of upper and lower support portions 32*a* and 32*b* are formed so as to extend forward as shown in FIGS. 3 to 5, etc. A pair of right and left support shafts 33*b* and 33*a* extending through the respective support portions 32*a* and 32*b* are mounted on the carriage 19 so as to be vertically movable. A Z-axis motor 34 comprising, for example, a stepping motor is accommodated in the carriage 19 backward thereby to be housed therein. The Z-axis motor 34 has a rotating shaft 34*a* (see FIGS. 3 and 5) which extends through a hole (not shown) of the front wall 19*c* of the carriage 19. The rotating shaft 34*a* has a distal end provided with a gear 35. Furthermore, the carriage 19 is provided with a gear shaft 37 which extends through a hole (not shown) formed in a slightly lower part of the gear 35 relative to the central part of the front wall 19*c* as shown in FIGS. 5, 6 and 9. A gear 38 is rotatably mounted on the gear shaft 37 and adapted to be brought into mesh engagement with the gear 35 in front of the front will 19*c* is rotatably mounted on the gear shaft 37. The gear 38 is retained by a retaining ring (not shown) mounted on a front end of the gear shaft 37. The gears 35 and 38 constitute a third reduction mechanism 41 (see FIGS. 3 and 5).

The gear 38 is formed with a spiral groove 42 as shown in FIG. 6. The spiral groove 42 is a cam groove formed into a spiral shape such that the spiral groove 42 comes closer to the center of the gear 38 as it is turned rightward from a first end 42*a* toward a second end 42*b*. An engagement pin 43 which is vertically moved together with the cutter holder engages the spiral groove 42 (see FIG. 4) as will be described in detail later. Upon normal or reverse rotation of the Z-axis motor 34, the gear 38 is rotated via the gear 35. Rotation of the gear 38 vertically slides the engagement pin 43 in engagement with the spiral groove 42. With the vertical slide of the gear 38, the cutter holder 5 is moved upward or downward together with the support shafts 33*a* and 33*b*. In this case, the cutter holder 5 is moved between a raised position (see FIGS. 4 and 6) where the engagement pin 43 is located at the first end 42*a* of the spiral groove 42 and a lowered position (see FIGS. 5 and 6) where the engagement pin 43 is located at the second end 42*b*. A third moving unit 44 which moves the cutter holder 5 upward and downward is constituted by the above-described third reduction mechanism 41 having the spiral groove 42, the Z-axis motor 34, the engagement pin 43, the support portions 32*a* and 32*b*, the support shafts 33*a* and 33*b*, etc.

The cutter holder 5 includes a holder body 45 provided on the support shafts 33*a* and 33*b*, a movable cylindrical portion 46 which has a cutter 4 (a cutting blade) and is held by the holder body 45 so as to be vertically movable and a pressing device 47 which presses the object 6. More specifically, the holder body 45 has an upper end 45*a* and a lower end 45*b* both of which are folded rearward such that the holder body 45 is generally formed into a O-shape, as shown in FIGS. 3 to 5, etc. The upper and lower ends 45*a* and 45*b* are immovably fixed to the support shafts 33*a* and 33*b* by retaining rings 48 fixed to upper and lower ends of the support shafts 33*a* and 33*b*, respectively. The support shaft 33*b* has a middle part to which is secured a coupling member 49 provided with a rearwardly directed engagement pin 43 as shown in FIGS. 4 and 5. The holder body 45, the support shafts 33*a* and 33*b*, the engagement pin 43 and the coupling member 49 are formed integrally with one another. The cutter holder 5 is vertically moved by the third moving unit 44 in conjunction with the engagement pin 43. Furthermore, two compression coil springs 50 serving as biasing members are mounted about the support shafts 33*a* and 33*b* so as to be located between upper surfaces of the support portion and an upper end of the holder body 45, respectively. The entire cutter holder 5 is elastically biased upward by a biasing force of the compression coil springs 50 relative to the carriage 19.

Mounting members 51 and 52 provided for mounting the movable cylindrical portion 46, the pressing device 47 and the like are fixed to the middle portion of the holder body 45 by screws 54*a* and 54*b* respectively, as shown in FIG. 3. The lower mounting member 52 is provided with a cylindrical portion 52*a* (see FIG. 4) which supports the movable cylindrical portion 46 so that the movable cylindrical portion 46 is vertically movable. The movable cylindrical portion 46 has a diameter that is set so that the movable cylindrical portion 46 is brought into a sliding contact with the inner peripheral surface of the cylindrical portion 52*a*. The movable cylindrical portion 46 has an upper end on which a flange 46*a* supported on an upper end of the cylindrical portion 52*a* is formed so as to expand radially outward. A spring shoe 46*b* is provided on an upper end of the flange 46*a*. A compression coil spring 53 is interposed between the upper mounting member 51 and the spring shoe 46*b* of the movable cylindrical portion 46 as shown in FIG. 4. The compression coil spring 53 biases the movable cylindrical portion 46 (the cutter 4) to the lower object 6 side while allowing the upward movement of the movable cylindrical portion 46 against the biasing force when an upward force acts on the cutter 4.

A cutter shaft 58 extends through the movable cylindrical portion 46 in an axial direction of the latter. The cutter shaft 58 is formed into the shape of a long round bar and is longer than the movable cylindrical portion 46. The cutter shaft 58 has a lower end having a mounting member 59 to which the cutter 4 is to be mounted. The cutter 4 has a blade 4*a* which is titled relative to the object 6. The cutter 4 has a lowermost blade edge 4*b* which is formed so as to assume a position shifted from a central axis 4*z* of the cutter shaft 58 (see FIGS. 8B and 9A).

The movable cylindrical portion 46 has two bearings mounted on inner upper and lower ends thereof respectively. The cutter shaft 58 is mounted on the bearings 55 so as to be rotatable about the vertical central axis 4*z*, that is, a Z-axis as shown in FIG. 4. The cutter 4 presses the blade edge 4*b* against the X-Y plane or the surface of the object 6 from the Z direction perpendicular to the X-Y plane. Furthermore, the cutter 4 has a height that is set so that when the cutter holder 5 has been moved to the lowered position, the blade edge 4*c* passes through the object 6 on the holding sheet 10 but does not reach the upper surface of the plate member 3*b* of the platen 3, as shown in FIG. 9A. On the other hand, the blade edge 4*c* of the cutter 4 is moved upward with movement of the cutter holder 5 to the raised position, thereby being spaced from the object 6 (see FIG. 4).

The mounting member 52 has three guide holes 52*b*, 52*c* and 52*d* (see FIGS. 2 to 5) which are formed at regular intervals in a circumferential edge of the lower end of the cylindrical portion 52*a*. A pressing member 56 is disposed under the cylindrical portion 52*a* and has three guide bars 56*b*, 56*c* and 56*d* which are to be inserted into the guide holes 52*b* to 52*d* respectively. The pressing member 56 includes a lower part serving as a shallow bowl-shaped pressing portion body 56*a*. The aforementioned equally-spaced guide bars 56*b* to 56*d* are formed integrally on the circumferential end of the top of the pressing portion body 56*a*. The guide bars 56*b* to 56*d* are guided by the respective guide holes 52*b* to 52*d*, so that the pressing member 56 is vertically movable. The pressing portion body 56*a* has a central part formed with a through hole 56*a* which vertically extends to cause the blade 4*a* to protrude downward therethrough. The pressing portion body 56*a* has an underside serving as a contact surface 56*f* which is brought into contact with the object 6 around the blade 4*a*. The contact portion 56*f* is formed into an annular horizontal flat surface and is brought into surface contact with the object 6. The contact portion 56*f* is made of a fluorine resin such as Teflon® so as to have a lower coefficient of friction, whereupon the contact portion 56*f* is rendered slippery relative to the object 6.

The pressing portion body 56*a* has a connection 56*g* which is formed integrally on the circumferential edge thereof so as to extend forward, as shown in FIGS. 3 to 5 etc. On the other hand, the mounting member 52 has a front mounting portion 52*e* for the solenoid 57, integrally formed therewith. The front mounting portion 52*e* is located in front of the cylindrical portion 52*a* and above the connection 56*g*. The solenoid 57 serves as an actuator for vertically moving the pressing member 56 thereby to press the object 6. The solenoid 57 and the pressing member 56 constitute a pressing device 47 together with a control circuit 71 which will be described later. The solenoid 57 is mounted on the front mounting portion 52*e* so as to be directed downward. The solenoid 57 includes a plunger 57*a* having a distal end fixed to an upper surface of the connection 56*g*. When the solenoid 57 is driven with the cutter holder 5 assuming the lowered position, the pressing member 56 is moved downward together with the plunger 57*a* thereby to press the object 6 with a predetermined pressure (see FIG. 5). On the other hand, when the plunger 57*a* is located above during non-drive of the solenoid 57, the pressing member 56 releases the object 6 from application of the pressing force. When the cutter holder 5 is moved to the raised position during non-drive of the solenoid 57 (see two-dot chain line in FIG. 4), the pressing member 56 is completely spaced from the object 6.

The holding sheet 10 has an adhesive layer 10 which holds the object 6, as shown in FIG. 9A. When cut by the cutting apparatus 1, the object 6 is immovably held on the holding sheet 10 by a resultant adhesion force of the adhesive layer 10*a* and a pressing force of the pressing device 47. The holding sheet 10 serving as a holding member is made of, for example, a synthetic resin and formed into a flat rectangular plate shape, as shown in FIG. 1. The adhesive layer 10*a* is formed by applying an adhesive agent to an upper side of the holding sheet 10, that is, a side thereof opposed to the cutter 4. The sheet-like object 6 such as paper, cloth or resin film is removably held by the adhesive layer 10*a*. The adhesive layer 10*a* has an adhesion that is set to a small value such that the object 6 can easily be removed from the adhesive layer 10*a* without breakage of the object 6.

The cutting apparatus 1 according to the embodiment includes an angle change unit 60 which changes an angle made by the blade 4*a* of the cutter 4 and the object 6, between a non-cutting time and a cutting time. The following will describe a mounting structure of the angle change unit 60 and the cutter 4 with reference to FIGS. 8 to 8C. Firstly, the cutter 4 is formed of a flat plate-shaped metal, for example, and has the shape of a right-angled trapezium (see FIG. 8B). The cutter 4 has a lengthwise end formed with the diagonal blade 4*a* for cutting the object 6. The cutter 4 has right and left sides 4*c* and 4*d* formed into parallel opposite sides. The side 4*d* has a lowermost end corner serving as an acutely-formed blade edge 4*b* of the blade 4*a*. The cutter 4 has a circular through hole 4*e* formed in a lengthwise middle thereof.

The cutter 4 includes a mounting member 59 which is secured to a lower end of the cutter shaft 58 and formed into the shape of a generally rectangular block extending downward. The mounting member 59 has a lower half which is cut off into a substantially inverted L-shape except for one side 59*d* (a right side as viewed in FIG. 8) thereby to be formed into a mounting recess 61. In this case, the mounting recess 61 has a vertical plane 62 which is perpendicular to the X-Y plane and serves as a mounting surface for the cutter 4 located substantially on the central axis 4*z* of the cutter shaft 58 (see FIG. 8C). The mounting member 59 has a through hole 62*a* extending through a part thereof located slightly lower than the mounting surface 62. The cutter 4 is swingably mounted to the mounting surface 62 by a rivet 64 serving as a support shaft while the blade 4*a* is directed downward and extends along the mounting surface 62. In this case, the rivet 64 is in turn inserted through the through hole 4*e* of the cutter 4 and a through hole 62*a* of the mounting hole 62 and has a distal end crimped and spread to be formed into a locking end 64*a*. As a result, the rivet 64 is mounted so that a central axis 64*b* thereof is perpendicular to the central axis 4*z* of the cutter shaft 58.

The mounting recess 61 includes an inverted L-shaped inner wall 63 formed with a pair of abutments 63*a* and 63*b* capable of abutting against one side 4*d* of the cutter 4. The first abutment 63*a* is a vertically extending surface of the inner wall 63, and the second abutment 63*b* is a tilted surface that is continuous to the lower side of the first abutment 63*a* and is tilted a predetermined angle relative to the vertical surface of the first abutment 63*a*. As a result, when the cutter 4 is rotated about the rivet 64 alone the mounting surface 62, an angle made by the blade 4*a* and the object 6 is changed between a first angle $\alpha_1$ (see FIG. 9A) at which the side 4*d* of the cutter 4 abuts against the first abutment 63*a* and a second angle $\alpha_2$ (see FIG. 9B) at which the side 4*d* abuts against the second abutment 63*b*. In this case, the second angle $\alpha_2$ is set so as to be smaller than the first angle $\alpha_1$ ($\alpha_2<\alpha_1$).

A leaf spring 66 is disposed at the other side 59*c* of the mounting member 59 (at the left side as viewed in FIG. 8B) to elastically bias the other side 4*c* of the cutter 4. The leaf spring 66 is an elastic member which is formed of a flexible metal material into a band shape extending vertically along the side 59*c* of the mounting member 59. The leaf spring 66 has an upper portion or a proximal end provided with a screwing hole 66*a*. The leaf spring 66 has a distal end further having a pressing portion 66*b* facing the mounting recess 61 and bent to the side 4*c* side of the cutter 4.

The mounting member 59 has an upper side part 59*c* in which a screw hole 67 is formed. A screw 66 having been inserted through the hole 66*a* is further threadingly inserted into the screw hole 67, whereby the leaf spring 66 is mounted on the mounting member 59. The mounting member 59 has a lower side part 59*c* with a concave wall 69 formed by concaving the mounting recess 61 so that the mounting recess 61 has a width smaller than the width W of the cutter 4. As a result, the pressing portion 66*b* of the leaf spring 66 is normally in abutment with the side 4*c* of the cutter 4, whereby the cutter 4 is elastically biased in such a direction that the blade 4*a* makes the first angle $\alpha_1$ with the object 6.

When the blade 4*a* of the cutter 4 makes the first angle $\alpha_1$ with the object 6, the lowermost end blade edge 4*b* assumes a position shifted by distance d1 from the central axis 4*z* of the cutter shaft 58 and the cutter 4 assumes an initial position where the whole cutter 4 extends vertically, as shown in FIG. 9A. The leaf spring 66 has an elastic force that is set so that the blade 4*a* is changed from the first angle $\alpha_1$ to the second angle $\alpha_2$ by a resistance force (that will be referred to as "cutting resistance force") the cutter 4 receives from the object 6 with relative movement of the cutter 4 during cutting, as will be described in detail later. When the blade 4*a* is changed to the second angle $\alpha_2$, the whole cutter 4 assumes a tilted position such that an offset from the central axis 4*z* of the cutter shaft 58 assumes a value $d_2$ (see FIG. 9B). Furthermore, the cutter 4 rotatable about the central axis 4*z* receives the cutting resistance force during cutting to automatically change its direction in the direction of relative movement of the cutter 4, that is, along a line segment composing the cutting line.

The above-described mounting member 59, the leaf spring 66, the rivet 64, the abutments 63*a* and 63*b* and the like constitute an angle change unit 60. Furthermore, the leaf spring 66 and the first abutment 63*a* serve as a first angle maintenance unit 70 that is configured to maintain the cutter 4 at the first angle. Since the mounting member 59 employed in the embodiment limits swing of the cutter 4 using the inner walls 62 and 63 of the mounting recess 61, the configuration of the angle change unit 60 can be rendered simpler and more compact.

The arrangement of the control system of the cutting apparatus 1 will now be described with reference to a block diagram of FIG. 7. A control circuit (a control unit) 71 controlling the entire cutting apparatus 1 is mainly composed of a computer (CPU). A ROM 72, a RAM 73 and an external memory 74 each serving as a storage unit are connected to the control circuit 71. The ROM 72 stores a cutting control program for controlling the cutting operation, various control data and the like. The RAM 73 is provided with storage areas for temporarily storing various data and program necessary for execution of each processing. The external memory 74 stores pattern cutting data for a plurality of patterns. The aforementioned cutting data includes data of n-number of line segments $L_1$ to $L_n$ composing the cutting line L.

Figure 10:
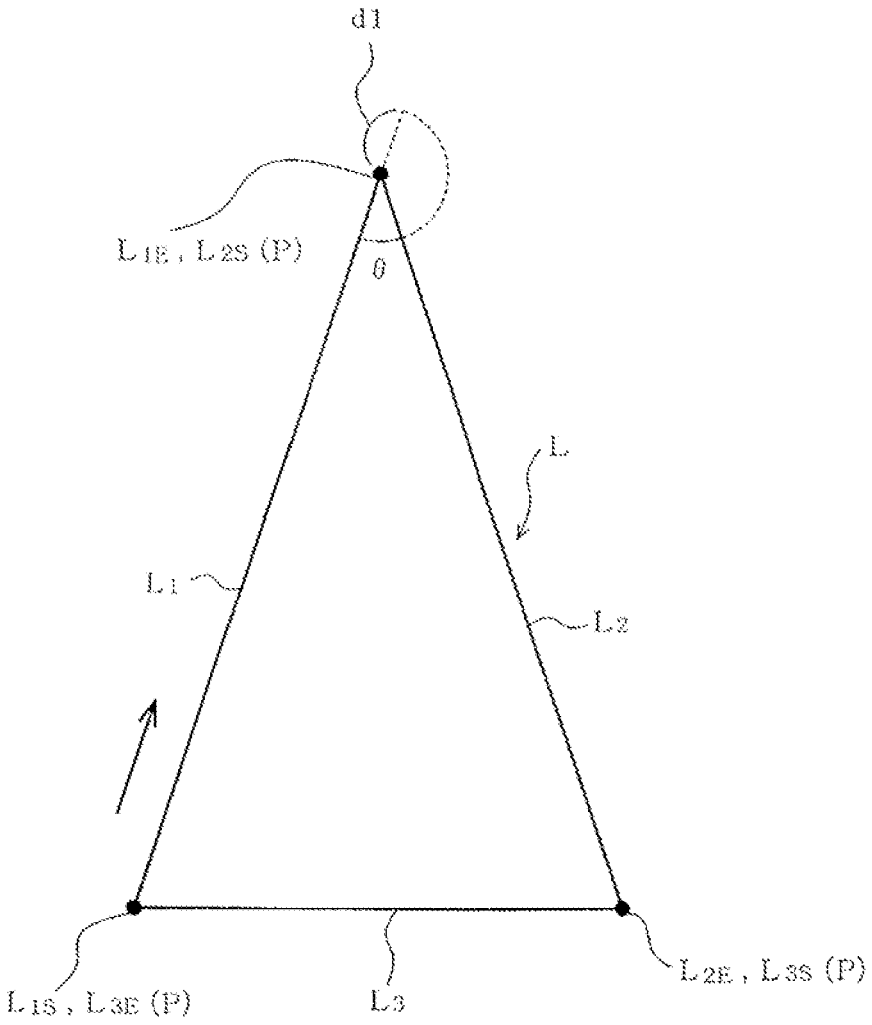
FIG. 10 illustrates an example of a cutting line of the object.
Figure 11:
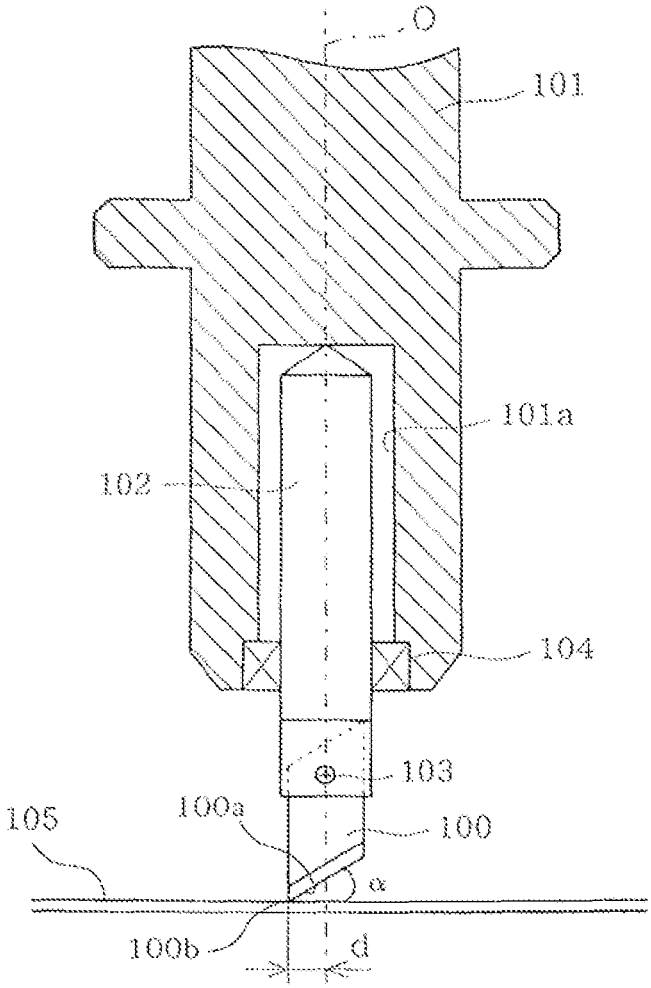
FIG.11 RELATED ART
FIG. 11 is an enlarged sectional view of the distal end of a cutter holder commonly used in conventional cutting plotters.

A triangle is to be cut out of the object 6 that is a sheet, such as paper, held on the holding sheet 10, for example, as shown in FIG. 10. In this case, the cutting data includes data of three line segments $L_1$ to $L_3$ composing the cutting line. More specifically, the line segments $L_1$ to $L_3$ have starting points $L_{1S}$ to $L_{3S}$ and ending points $L_{1E}$ to $L_{3B}$ respectively. Furthermore, since the line segments $L_1$ to $L_3$ are continuous and constitute a closed cutting line L, the starting point of each line segment corresponds with the ending point of a neighboring line segment and the ending point of each line segment corresponds with the starting point of a neighboring line segment. The starting and ending points of the line segments $L_1$ to $L_3$ are represented by X-Y coordinates.

Operation signals generated by various operation switches 9*b* are supplied to the control circuit 71. The control circuit 71 controls a displaying operation of the LCD 9*a*. In this case, while viewing the displayed contents of the LCD 9*a*, the user operates the switches 9*b* to select and designate pattern cutting data of a desired pattern. Detection signals are also supplied to the control circuit 71 from various sensors 75 such as a sensor for detecting the holding sheet 10 set from the opening 2*a* of the cutting apparatus 1. To the control circuit 71 are connected drive circuits 76 to 79 driving the Y-axis, X-axis and Z-axis motors 15, 26 and 34 and the solenoid 57. Upon execution of the cutting control program, the control circuit 71 controls various actuators such as the Y-axis, X-axis and Z-axis motors 15, 26 and 34 and the solenoid 57, based on the cutting data, whereby the cutting operation is automatically executed for the object 6 on the holding sheet 10.

The cutting apparatus 1 constructed and arranged as described above will work as follows. The aforementioned triangle will also be exemplified in the following description, and commonly-used paper will be used as the object 6. The cutter holder 5 assumes the raised position (see FIG. 4) before the cutting apparatus 1 starts cutting the object 6. In this state, the user applies the object 6 to the adhesive layer 10*a* so that the object 6 is held by the holding sheet 10. The holding sheet 10 is then set to the cutting apparatus 1 through the opening 2*a*. When the user selects a desired one of the cutting data stored on the external memory 74, for example, the selected cutting data is read to be stored on a memory of the RAM 73. Upon operation of the operation switches 9*b*, the control circuit 71 starts a cutting operation based on the supplied operation signals.

In the cutting operation, the X-axis and Y-axis motors 26 and 15 are driven to relatively move the cutter 4 so that the blade edge 4*b* of the cutter 4 assumes the X-Y coordinates (see FIG. 10) of the starting point $L_{1S}$ of line segment $L_1$. In this state, the solenoid 57 is then driven to cause the pressing member 56 to press the object 6. Furthermore, the Z-axis motor 34 is driven to move the cutter holder 5 to the lowered position, so that the blade edge 4*b* of the cutter 4 passes trough the object 5 at the starting point $L_{1S}$. In this case, the cutter 4 is retained in the initial position during the non-cutting time by the elastic force of the leaf spring 66, so that the blade 4*a* makes the first angle $\alpha$1 with the object 6 as shown in FIG. 9A. Accordingly, the blade edge 4*b* of the cutter 4 can be pressed against the object 6 thereby to smoothly snick the object 6.

The motors 15 and 26 are then driven so that cutting is started by moving the cutter 4 and the object 6 relative to each other toward the coordinate of the ending point $L_{1E}$ of the line segment $L_1$. In the cutting, the blade edge 4*b* of the cutter 4 is subjected to the cutting resistance force from the object 6. The cutting resistance force causes the cutter 4 to assume a tilted position against the elastic force of the leaf spring 66 such that the angle made by the blade 4*a* and the object 6 is changed from the first angle $\alpha_1$ to the second angle $\alpha_2$.

Figure 8C:
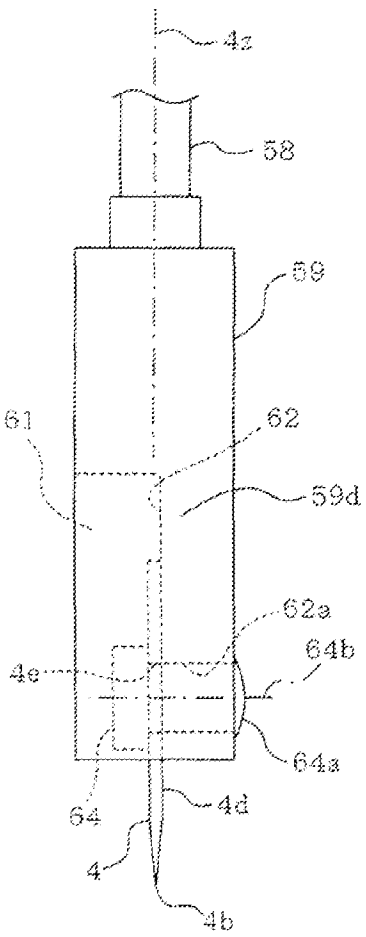
FIGS. 8A, 8B and 8C are enlarged left side, front and right side views of the cutter and its mounting structure respectively.
Figure 8B:
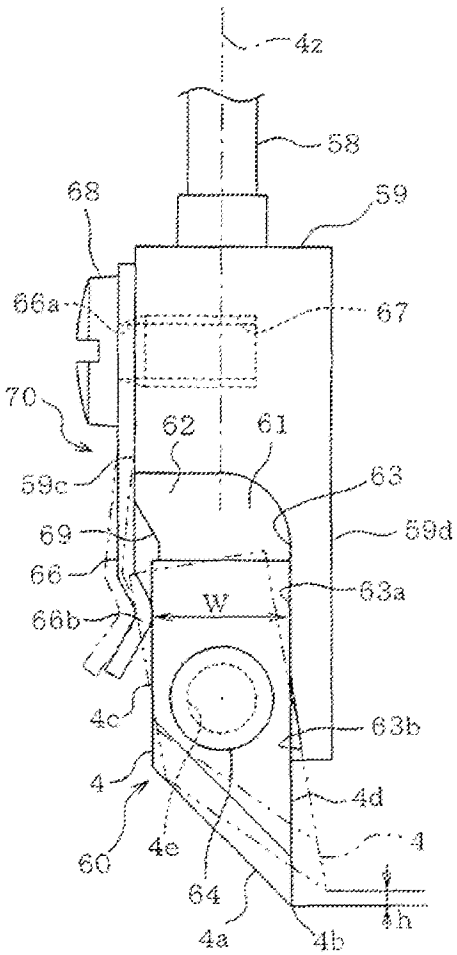
Figure 8A:
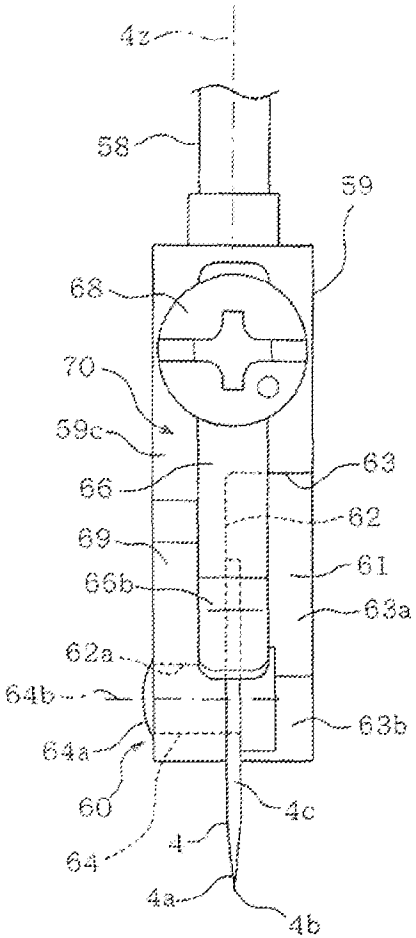
Figure 9B:
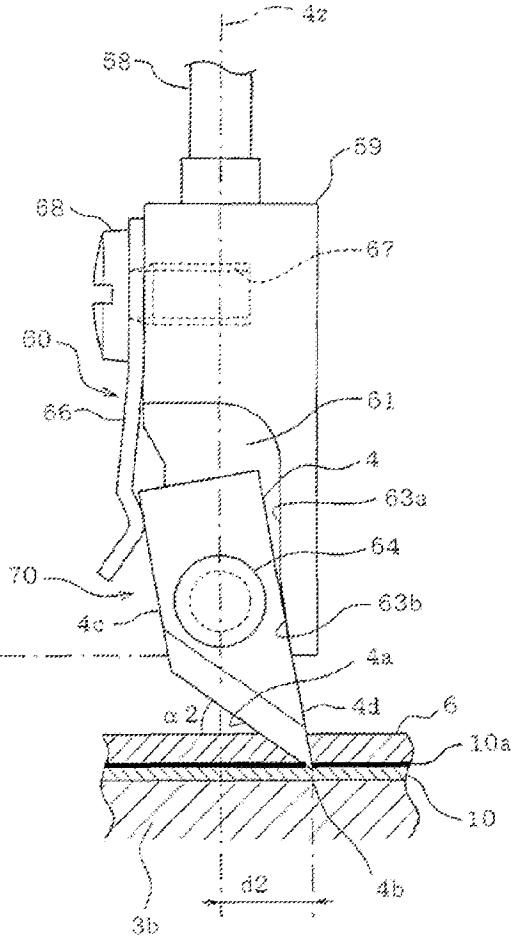
FIGS. 9A and 9B are similar to FIG. 8B, showing the cutter and an object to be cut during non-cutting and cutting respectively.
Figure 9A:
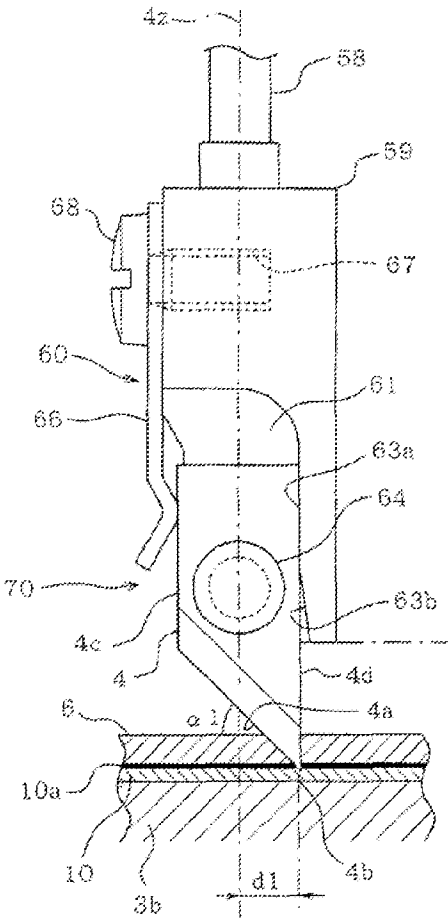

In this case, furthermore, since the cutter 4 is rotated about the central axis 64*b* such that the blade edge 4*b* is slightly moved upward, the Z-axis motor 34 is driven so that the cutter 4 is controlled to be moved downward by an amount of the upward movement of the blade edge 4*b* (shown as distance h in FIGS. 8B, 9A and 9B). As a result, the blade edge 4*b* is maintained in a state where the blade edge 4*b* has passed through the object 6, and the cutting is executed under the condition where the angle made by the blade edge 4*b* and the object 6 is set to the second angle $\alpha_2$ that is smaller then the first angle $\alpha_1$.

When the object 6 is cut along the cutting line $L_1$ toward the apex P ($L_{1E}$) in FIG. 10, the blade edge 4*b* of the cutter 4 is offset by distance $d_2$ from the central axis 4*z* of the cutter shaft 58 as described above. When the blade edge 4*b* has reached the apex P (the ending point $L_{1E}$), the cutting is interrupted in order that the direction of the blade edge 4*b* may be changed at point P. In this case, the central axis 4*z* of the cutter shaft 58 located distance $d_2$ away from the apex P that is an extension of the line segment $L_1$ in FIG. 10. Accordingly, the cutter shaft 56 is moved (returned) in the opposite direction by distance $d_3$ ($d_3$-$d_2$-$d_1$). In this case, the blade edge 4*b* is moved upward by distance h. As a result, the cutter 4 is returned the initial position by the elastic force of the leaf spring 66 (see FIG.

9A), whereby the angle made by the blade 4*a* and the object 6 is changed to the first angle $\alpha_1$. The central axis 4*z* is located distance $d_1$ away from the apex P that is the extension of the line segment $L_1$ in FIG. 10.

Then, in order that the direction of the blade 4*b* may be changed so that the blade 4*b* is directed along the line segment $L_2$, the cutter 4 is moved so that the central axis 4*z* conforms with the broken line (arc). In this case, since the blade edge 4*b* slightly bites into the holding sheet 10 through the object 6, the portion of the apex P of the cutting line L is slightly pried or kinked. However, since the cutter 4 is retained in the initial position where the angle made by the blade 4*a* and the object 6 is the first angle $\alpha_1$, the direction of the blade 4*a* can be more easily changed while an area to be pried can be rendered as small as possible. Thus, after the direction of the blade edge 4*b* has been changed so as to conform with the line segment $L_2$, the cutting of the line segment $L_2$ is carried out in the same manner as in the case of the above-described line segment $L_3$ while the angle made by the blade 4*a* and the object 6 is changed to the second angle $\alpha_2$. The cutting of the line segment $L_1$ is also carried out in the same manner as in the cases of the line segments $L_1$ and $L_2$ with the use of the second angle $\alpha_2$.

When the line segments of the cutting line L include a gentle curve having a large curvature radius, differing from the triangle in FIG. 10, the direction of the blade edge 4*b* is automatically changed so as to conform with the relative movement of the cutter 4 and accordingly, the cutting is carried out with the use of the second angle $\alpha_2$ in the same manner as of the line segments $L_1$ to $L_3$.

Upon completion of the cutting, the user removes the object 6 from the holding sheet 10. During the cutting, the solenoid 57 is driven so that the object 6 is pressed by the contact surface 56*f*, and the object 6 can be held by the adhesion of the adhesive layer 10*a* of the holding sheet 10 so as not to be displaced. Furthermore, the pressing member 56 is moved relative to the object 6 in the cutting. However, since the contact surface 56*f* of the pressing member 56 is formed of a material with a low friction coefficient, the friction caused between the contact surface 56*f* and the object 6 can be reduced as much as possible. Consequently, the object 6 can also be prevented from displacement due to the frictional force. Accordingly, the object 6 can be held more reliably and an accurate cutting line can be formed.

The cutting apparatus 1 according to the above-described embodiment is provided with the angle change unit 60 which changes the angle of the blade 4*a* of the cutter between the first angle $\alpha_1$ in the non-cutting time and the second angle $\alpha_2$ at which the cutter 4 is tilted so that the angle of the blade 4*a* is rendered smaller than the first angle $\alpha_1$ during the cutting.

According to the above-described configuration, since the angle of the blade 4*a* is changed from the first angle $\alpha_1$ to the second angle $\alpha_2$ by the angle change unit 60 during the cutting, the angle of the blade 4*a* is rendered smaller. As a result, the cutting resistance force to which the cutter 4 is subjected from the object 6 can be rendered smaller, whereupon the sharpness of the cutter 4 can be improved. Furthermore, when the cutter 4 is not relatively moved in the non-cutting time, the angle made by the blade 4*a* and the object 6 can be increased to the first angle $\alpha_1$ by the angle change unit 60. Accordingly, for example, when a corner of the cutting line is to be cut, the relative movement of the cutter 4 is once stepped at the apex P of the corner, so that the angle made by the blade 4*a* and the object 6 is changed to the first angle $\alpha_1$, whereby the direction (cutting direction) of the cutter 4 can easily be changed and the relative movement of the cutter 4 can suitably be carried out.

The angle change unit 60 is provided with the first angle maintenance unit 70 that is configured to maintain the cutter 4 at the first angle during the non-cutting time. As a result, since the cutter 4 is retained in the state where the angle made by the blade 4*a* and the object 6 is larger, the blade edge 4*b* of the cutter 4 can be pressed against the object 6 thereby to smoothly snick the object 6.

The first angle maintenance unit 70 includes the elastic member that is configured to elastically bias the cutter 4 in such a direction that the angle made by the blade 4*a* and the object 6 is the first angle $\alpha_1$. Consequently, the blade 4*a* can be maintained at the first angle $\alpha_1$ by a simple configuration of the elastic member.

The elastic member has an elastic force that is set so that the blade 4*a* is changed from the first angle $\alpha_1$ to the second angle $\alpha_2$ by a resistance to which the blade 4*a* is subjected with relative movement of the cutter 4 during the cutting period. Accordingly, no means for change the angle made by the blade 4*a* and the object 6 needs to be separately provided, whereupon the configuration of the angle change unit 60 can be rendered highly simple.

The angle change unit 60 includes a support shaft the rivet 64) which supports the cutter 4 so that the cutter 4 is swingable between the first and second angles $\alpha_1$ and $\alpha_2$, the mounting member 59 which fixes the support shaft, the first abutment 63*a* which limits the swing of the cutter 4 when the angle made by the blade 4*a* and the object 6 is the first angle $\alpha_1$, the second abutment 63*b* which limits the swing of the cutter 4 when the angle made by the blade 4*a* and the object 6 is the second angle $\alpha_2$, and the elastic member which is provided between the mounting member 59 and the cutter 4 to elastically bias the cutter 4 in such a direction that the cutter 4 abuts against the first abutment 63*a* during the non-cutting time.

According to the above-described configuration, when the cutter 4 is abutted against the first or second abutment 63*a* or 63*b*, the cutter 4 can be held in the tilted state with the angle made by the blade 4*a* and the object 6 being the first or second angle $\alpha_1$ or $\alpha_2$ during the non-cutting time. Furthermore, the change in the angle of the cutter 4 can be realized by a simple configuration using the mounting member 59 having the abutments 63*a* and 63*b*, the support shaft supporting the cutter 4 and the elastic member. Still furthermore, the blade 4*a* is changed from the first angle $\alpha_1$ to the second angle $\alpha_2$ by the cutting resistance force to which the cutter 4 is subjected from the object 6, against the elastic force of the elastic member. Accordingly, the configuration for chancing the angle of the cutter 4 can be rendered further simpler.

The foregoing embodiment should not be restrictive but may be modified or expanded as follows. The embodiment may be applied to various types of devices and apparatus each having a cutting function as well as the cutting apparatus serving as the cutting plotter.

The elastic member may be a torsion spring or a rubber member having a predetermined elasticity, instead of the leaf spring 66. The support shaft swingably supporting the cutter 4 may be a shoulder screw, instead of the rivet 64. More specifically, the shoulder screw includes a head, a thread and a shaft provided between the head and the thread, although not shown. The screw shaft has a larger diameter than the screw thread such that the shoulder screw is stepped. The shoulder screw is inserted through the insertion hole 4*e* of the cutter 4 to the screw shaft, and the screw thread is threadingly engaged with an inner thread (not shown) formed on the mounting member 59. As a result, the shoulder screw serves as a support shaft which supports the cutter 4 by the screw shaft thereof so that the cutter 4 is swingable.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A cutting apparatus in which a cutting blade and an object to be cut are moved relative to each other based on cutting data set therein so that the object is cut into a desired shape by the cutting blade, the apparatus comprising:

an angle change unit which is configured to change an angle made by the cutting blade and the object, wherein the angle change unit is configured to change the angle between a first angle during a non-cutting time and a second angle at which the cutting blade is tilted during a cutting time so that the second angle is rendered smaller than the first angle, wherein the angle change unit includes:

a support shaft which supports the rutting blade between the first and second angles so that the coning blade is swingable;

a mounting member which fixes the support shaft;

a pair of first and second abutments which are mounted on the mounting member so as to be capable of abutting against the cutting blade, the first abutment limiting the swinging movement of the cutting blade when abutting against the cutting, blade while the first angle is made by the cutting blade and the object, the second abutment limiting the swinging movement of the cutting blade when abutting against the cutting blade while the second angle is made by the cutting blade and the object;

an elastic member which is provided between the mounting member and the cutting blade to elastically bias the cutting blade in a direction such that the cutting blade abuts against the first abutment during the non-abutting period, and wherein the angle between the cutting blade and the object is changed from the first angle to the second angle by a resistance to which the cutting blade is subjected from the object during the cutting time with the relative movement of the cutting blade during the cutting time.

* * * * *